US005589865A

United States Patent [19]

Beeson

[11] Patent Number: 5,589,865

[45] Date of Patent: Dec. 31, 1996

[54] INKJET PAGE-WIDE-ARRAY PRINTHEAD CLEANING METHOD AND APPARATUS

[75] Inventor: Robert R. Beeson, Corvallis, Oreg.

[73] Assignee: Hewlett-Packard Company, Palo Alto, Calif.

[21] Appl. No.: 356,592

[22] Filed: Dec. 14, 1994

[51] Int. Cl.[6] ..... B41J 2/165

[52] U.S. Cl. ..... 347/28; 347/30; 347/33

[58] Field of Search ..... 347/30, 29, 33, 347/32, 101, 22, 28; 134/6

[56] References Cited

U.S. PATENT DOCUMENTS

| | | | |
|---|---|---|---|
| 4,369,456 | 1/1983 | Cruz-Uribe et al. | 346/140 R |
| 4,853,717 | 8/1989 | Harmon et al. . | |
| 4,933,015 | 6/1990 | White | 134/6 |
| 4,947,190 | 8/1990 | Mizusawa et al. | 347/33 |
| 5,040,000 | 8/1991 | Yokoi | 347/30 |
| 5,103,244 | 4/1992 | Gast et al. . | |
| 5,115,250 | 5/1992 | Harmon et al. . | |
| 5,146,243 | 9/1992 | English et al. . | |
| 5,155,497 | 10/1992 | Martin et al. . | |
| 5,250,962 | 10/1993 | Fisher et al. | 347/32 |
| 5,300,958 | 4/1994 | Burke et al. . | |

FOREIGN PATENT DOCUMENTS

| | | | |
|---|---|---|---|
| 0589604 | 3/1994 | European Pat. Off. . | |
| 3817754 | 11/1989 | Germany . | |
| 2218049 | 11/1989 | United Kingdom | B41J 29/00 |
| 2238510 | 6/1991 | United Kingdom | G41J 2/165 |

OTHER PUBLICATIONS

Dangelo et al., "Print Cartridge Fixturing and Maintenance in the HP Deskjet 1200C Printer;" Hewlett–Packard Journal; Feb. 1994.

*Primary Examiner*—Benjamin R. Fuller
*Assistant Examiner*—David Yockey

[57] ABSTRACT

A cleaning media is fed adjacent to a page-wide-array ("PWA") printhead along a paper path. The cleaning media includes a solvent pad and an absorbent pad coupled to a backing material. The backing material defines an opening along a substantial width of the material and has size dimensions approximating that of conventional paper. The solvent pad includes a specific solvent appropriate for a particular ink composition. During operation the solvent pad is fed adjacent to the printhead causing the solvent to react with ink on the printhead. The absorbent pad trails the solvent pad and wipes away the ink and solvent. The absorbent pad is a lint-free pad which attracts dust and other contaminants. The opening trails the solvent pad and absorbent pad during use. A vacuum wand scans the printhead through the opening sucking up contaminants loosened by the solvent pad and absorbent pad. The solvent pad and absorbent pad each have sufficient compliance to scrub/brush the printhead. In one embodiment, the solvent pad absorbent pad and opening are angled across the page-width. The angling allows the printhead surface to be scrubbed with solvent at one end then progressively scrubbed along its length to the opposite end. Similarly, the printhead surface can be brushed with the absorbent pad at one end then progressively brushed along its length. Further, angling the opening enables the vacuum wand to scan the printhead through the opening while the cleaning media moves adjacent to the printhead.

7 Claims, 2 Drawing Sheets

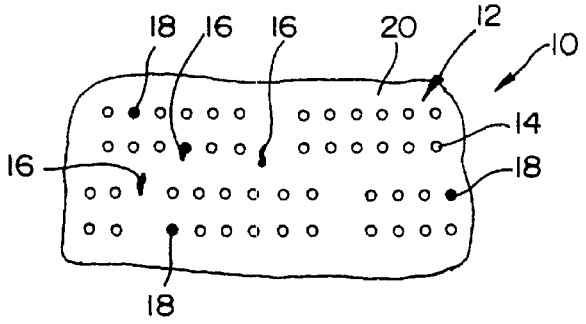
FIG. 1
FIG. 2
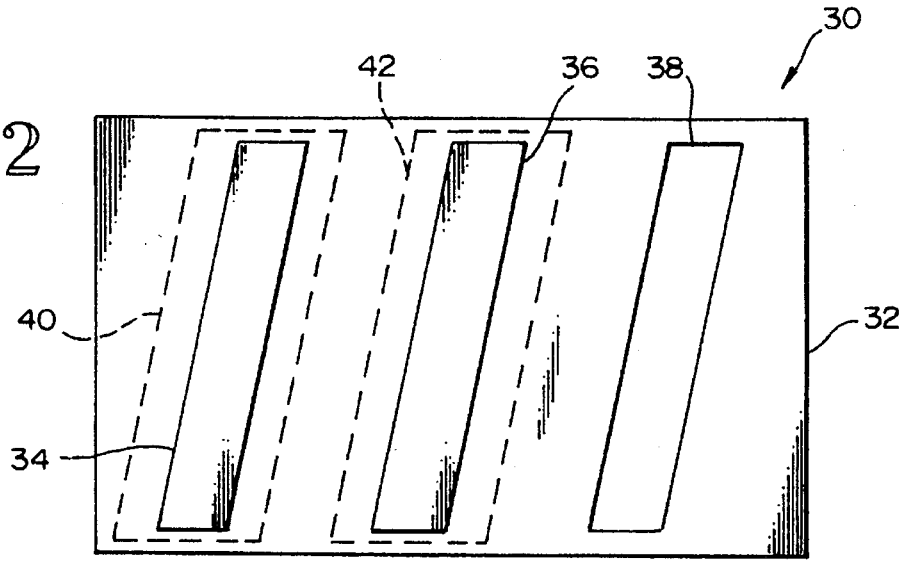
FIG. 3
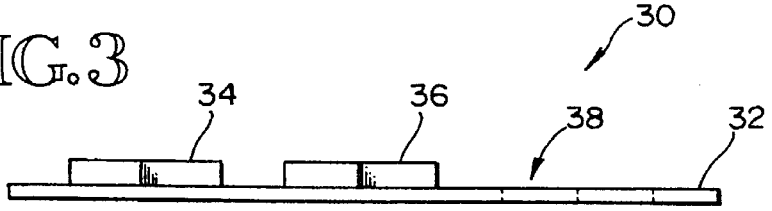

INKJET PAGE-WIDE-ARRAY PRINTHEAD CLEANING METHOD AND APPARATUS

BACKGROUND OF THE INVENTION

This invention relates to a method and apparatus for cleaning an inkjet printhead, and more particularly to a cleaning media and a method of cleaning a page-wide-array printhead with the cleaning media.

Inkjet printers eject liquid ink through multiple nozzles to form characters and graphics on a page. Print quality is dependent upon printer resolution and printhead performance. Printing at a 300 dpi ("dots per inch") resolution yields print quality comparable to 300 dpi laserjet printing. To achieve reliable performance, the inkjet printhead and inkjet process are designed to precisely control inkjet output. By controlling the timing, placement and volume of inkjet output droplets, reliable, repeatable character performance and graphic performance is achieved.

A clogged nozzle adversely impacts the placement and volume of inkjet output droplets as the ink droplet may be deflected from its intended destination and less than all ink may escape the nozzle. A seldom used nozzle may get dried ink or contaminants lodged in its orifice. Hot and dry environmental conditions, for example, speed up the drying process and may cause nozzles to clog. Also, contaminants from the external environment or from the printing process may get lodged in a nozzle blocking an orifice. Such clogging may occur despite design efforts to minimize ink drying and maintain a clean printhead environment. Accordingly, there is an ongoing need to provide methods and apparatii for cleaning inkjet printheads.

Conventional inkjet printheads span less than one inch and are scanned across the page. To perform a print operation the printhead is moved in one direction while the page is moved in a perpendicular direction. In effect the printhead scans the page while ejecting ink droplets to form the desired printout. When not in use the printhead moves into a service area where the printhead is cleaned then capped. As the printhead moves into a rest position, it traverses an elastomeric wiper (e.g., nitrile rubber). The wiper wipes ink from the printhead surface. Scrapers are then used in some embodiments to clean off the wipers.

A page-wide-array ("PWA") printhead spans an entire pagewidth (e.g., 8.5 inches) and includes thousands of nozzles. The PWA printhead thus has many more nozzles than the scanning-type printheads discussed above. The PWA printhead is formed on an elongated printbar. The printbar typically is oriented orthogonally to the paper path. During operation, the printbar and PWA printhead are fixed while a page is fed adjacent to the printhead. The PWA printhead prints one or more lines at a time as the page moves relative to the printhead. This compares to the printing of multiple characters at a time as achieved by scanning-type printheads.

Depending on the printout characteristics, certain nozzles on a PWA printhead may be exercised less than other nozzles. For example, a user may print most of the time using one inch margins, and on occasion use less than one inch margins. The nozzles in the one inch margin area, thus get exercised less regularly, and may clog more readily. This characteristic of uneven nozzle exercise is less common for a scanning-type printhead. Scanning printhead nozzles that start out in the margin area subsequently move out of the margin area and get exercised as the printhead scans the pagewidth.

Thus, certain nozzles on a PWA printhead are more prone to clogging than on a scanning-type printhead. In general, the problem of drying ink is more pronounced for a PWA printhead than for a scanning-type printhead. Accordingly, there is a need for an effective cleaning methodology for PWA printheads.

One solution would be to remove the printbar and clean the printhead in a manner similar to the cleaning of scanning-type printheads. However, to maintain reliable, accurate printing, the printbar is fixed and precisely positioned. There are several mechanical attachments that have to be undone to remove the printbar. Thus, the process would be timely and require careful actions. Also, repeated insertion and removal may wear on the components used for precisely fixing the printbar adding play to the printbar. Thus, it is desirable to use a cleaning methodology for cleaning the printhead while in place.

SUMMARY OF THE INVENTION

According to the invention, a page-wide-array ("PWA") inkjet printhead is operated in a cleaning mode, while a cleaning media is fed adjacent to the printhead along a media feed path. The cleaning media removes dried ink and contaminants from the printhead by a scrubbing and brushing action achieved by passing the cleaning media along the media feed path of a host printer. The cleaning media includes a solvent source that moves against the printhead to loosen and dissolve dried ink (e.g., scrub). The cleaning media also includes an absorbent pad that moves against the printhead to remove solvent, ink and contaminants (e.g., brush). In addition, a vacuum wand scans the printhead sucking up contaminants loosened by the cleaning media. The brushing and vacuuming actions substantially dry the printhead.

According to one aspect of the invention, the cleaning media includes a solvent pad and an absorbent pad coupled to a backing material. The backing material has size dimensions approximating that of conventional paper, (e.g., 8.5"× 11", A4) A cardstock weight is preferred for the backing material to support the pads. The solvent pad includes a specific solvent appropriate for a particular ink composition. As most inkjet printer inks are water-based, the primary solvent is water. A surfactant compound also is included in the solvent to reduce ink surface tension for easier cleaning. During operation the solvent pad is fed adjacent to the PWA printhead causing the solvent to react with any ink on the printhead. The absorbent pad trails the solvent pad and wipes away the ink and solvent. The absorbent pad is a lint-free pad which attracts dust and other contaminants on the printhead surface or clogging the nozzle orifii. The absorbent pad wipes the printhead substantially dry.

According to another aspect of the invention, the pad thickness (i.e., height) for the solvent pad and absorbent pad is approximately twice the conventional spacing between a page and the printhead (e.g., 2×1 mm=2 mm). The solvent pad and absorbent pad each have sufficient compliance to scrub and brush the printhead clean. The width of each pad spans the printhead approximating the page-width of the backing material. The length of each pad is designed to allow sufficient action at the printhead to remove dried ink and dislodge contaminants.

According to another aspect of the invention, the solvent pad and absorbent pad are angled across the page-width of the backing material. As the media is fed through the printer, a section of a solvent pad first contacts a section of the printhead. For a pad angling downward, the solvent pad first contacts one end area of the printhead surface. As the media progresses along the paper path, the portion of the solvent pad in contact with the printhead changes. In addition the area of the printhead surface contacted changes. The printhead surface is scrubbed with solvent at one end then progressively scrubbed along its length to the opposite end. Similarly, the absorbent pad first contacts an end of the printhead surface. The printhead surface is wiped with the absorbent pad at one end then progressively wiped along its length to the opposite end. By only scrubbing a portion of the printhead at one time, there is less pressure applied to the printhead, and thus, less risk of moving the printbar.

According to another aspect of the invention, the inkjet printer is operated in a cleaning mode while the cleaning media is fed through the paper path. During the cleaning mode no ink is fed to the printhead nozzle surface areas. By keeping ink from the nozzle surface areas, the solvent reacts only with the residual ink to be wiped away. In addition the pagefeed cycle is slowed so that the cleaning media proceeds along the paper path less rapidly than during normal printing. Thus, the pads spend more time adjacent to the printhead scrubbing and wiping than they would otherwise.

According to another aspect of the invention, a vacuum wand scans the printhead during the cleaning mode sucking up contaminants loosened by the solvent pad and absorbent pad. In one embodiment the cleaning media defines an opening into which the vacuum wand extends during the vacuum action. As the cleaning media is fed through the media path, first the solvent pad, then absorbent pad brushes the printhead. When the cleaning media opening aligns with the printhead, the vacuum wand begins to scan the printhead. The vacuum wand linearly scans the length of the printhead as the cleaning media moves under the printhead (and in particular the media opening moves under the printhead). The vacuum wand extends through the opening to contact the printhead surface during the scan. Because the vacuum wand is moving in a straight line across the printhead and because the cleaning media is moving perpendicular to such wand movement, the vacuum wand motion relative to the cleaning media is angled. To enable action between the wand and printhead through the opening, the opening is angled to approximate the angle of relative motion. Alternatively, the opening has sufficient width to enable the vacuum wand to make an entire scan of the printhead through the opening.

One advantage of the invention is that the printhead is cleaned without removal from the printer. The end user just selects the cleaning mode and feeds in the cleaning media. These and other aspects and advantages of the invention will be better understood by reference to the following detailed description taken in conjunction with the accompanying drawings.

BRIEF DESCRIPTION OF THE DRAWINGS

FIG. 1 is a partial view of a page-wide-array printhead surface showing clogged nozzles and dried ink;

FIG. 2 is a planar top view of the cleaning media according to one embodiment of this invention;

FIG. 3 is a planar side view of the cleaning media of FIG. 2;

DESCRIPTION OF SPECIFIC EMBODIMENTS

Overview

Figure 4:
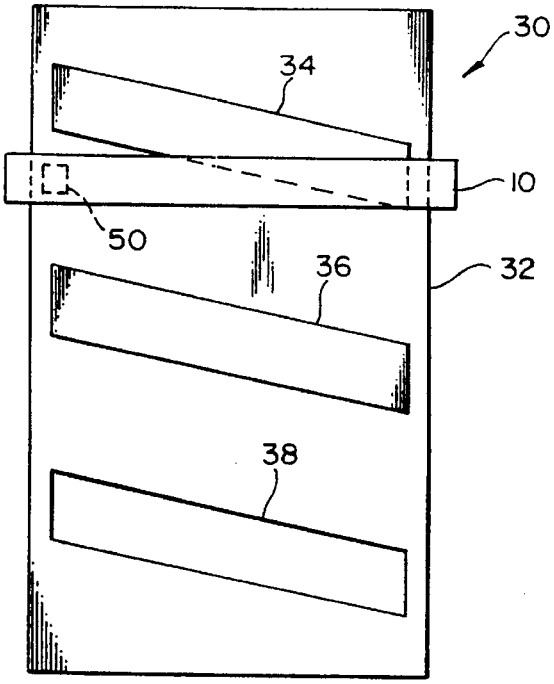
FIG. 4 is a planar top view of the cleaning media of FIG. 2 being fed adjacent to a page-wide-array printhead according to an embodiment of the method of this invention.

FIG. 1 shows a partial view of a page-wide-array ("PWA") inkjet printhead 10. The page-wide-array printhead 10 is formed by a surface 20 having thousands of nozzles 14 organized in groups 12. The surface 20 extends an entire pagewidth. The function of the PWA printhead 10 is to eject liquid ink droplets onto a page to form characters and graphics. The PWA printhead 10 is a stationary printhead which prints one or more lines at a time. This contrasts with scanning type inkjet printheads which move across a page and print one or more characters at a time. Because inkjet printers use liquid ink, there is an inherent potential that residual ink may dry on the printhead. Because the ink droplets are ejected through tiny orifii, there also is a potential that dried ink may clog an orifice. As the printers operate with various papers in an unsealed environment, there also is a potential that particles or contaminants may get stuck on the printhead or clog nozzle orifii. Dirty printheads having clogged nozzles adversely effect print quality. Clogged nozzles deflect ejected ink droplets from their intended locations and may decrease the ink volume delivered to the page.

As the PWA printhead does not scan across a media sheet, but instead is stationary while the media sheet is fed, relative motion occurs only in one direction (e.g., down a media sheet). Thus nozzles at the respective ends of the printhead are used for printing along the corresponding edges of a page. As those page edges may correspond to margins in many print jobs and peripheral text body in other print jobs, the end nozzles tend to be exercised less regularly than other nozzles. Regular use, however, is beneficial in that it deters against clogging. The regular firing of an inkjet droplet exerts a force through a nozzle clearing the orifice. For the conventional scanning printhead all nozzles get regular use, on average, because the end nozzles move out of a margin area across a page during a print job. Nozzles not getting regular use are more prone to clogging. Thus, the PWA printhead end nozzles are more prone to clogging. Further, keeping the printhead clean in general is a more significant problem, because the PWA printhead has hundreds more nozzles.

FIG. 1 shows a partial PWA surface 20 in which dried ink 16 and contaminants 18 clog several nozzles. Dried ink 16 also has set on the printhead surface 20.

Cleaning Media

FIGS. 2–3 show a cleaning media 30 according to one embodiment of this invention. The cleaning media 30 acts upon the printhead surface 20 to clean off the dried ink 16 and contaminants 18. The media 30 includes a backing sheet 32 upon which a solvent pad 34 and absorbent pad 36 are attached. In addition, at one portion of the backing sheet 32, an opening 38 is formed. Peel off tape sections 40, 42 cover the solvent pad 34 and absorbent pad 36 prior to use.

In one embodiment the backing sheet 32 is of standard paper size dimensions (e.g., 8.5×11, A4, legal size) and cardstock weight. Other dimensions also may be used.

However, the backing sheet is to be sufficiently wide for the pads 34, 36 to span substantially the entire surface 20 of the page-wide-array printhead 10. With regard to the cardstock weight, other weight thicknesses also may be used. The weight and thickness is to be sufficient to support the pads 34, 36, yet allow the cleaning media 30 to be feedable through a host printer.

The solvent pad 34 is formed of a compliant material having low abrasive characteristics so as not to damage the printhead 10. An exemplary material is a tight-celled foam sponge. A solvent for acting upon the dried ink is impregnated in the solvent pad 34. The actual solvent used will vary embodiment to embodiment depending on the ink being used by the host printer. As most inkjet printers use water-based inks, the primary solvent typically is water. A surfacant also is included in some embodiments to reduce surface tension and improve dissolution of the dried ink. Reactive solvents also may be used. However, as reactive solvents do not have a long shelf life, they are less desirable for embodiments expected to have a long shelf life.

The absorbent pad 36 is an antistatic pad also having low abrasive characteristics. An exemplary material is lint-free felt.

The length of the pads 34, 36 and opening 38 span at least the length of the PWA surface 20 portion having nozzles 14. Thus, when fed through the printer, the solvent pad 34, absorbent pad 36 and opening 38 encounter every nozzle 14. The width of the pads 43, 36 and opening 38 is somewhat arbitrary. In one embodiment the width is approximately the width of the PWA printhead. With regard to the solvent pad 34 and absorbent pad 36, the width need only be of a dimension which allows sufficient time exposure to the printhead surface 20 and nozzles 14 to remove the dried ink 16 and contaminants 18. Lastly, the thickness (i.e., height) of the solvent pad 34 and absorbent pad 36 are greater than the distance between print media and printhead so as to be sufficient to achieve a scrubbing or brushing action on the printhead surface 20.

Figure 5:
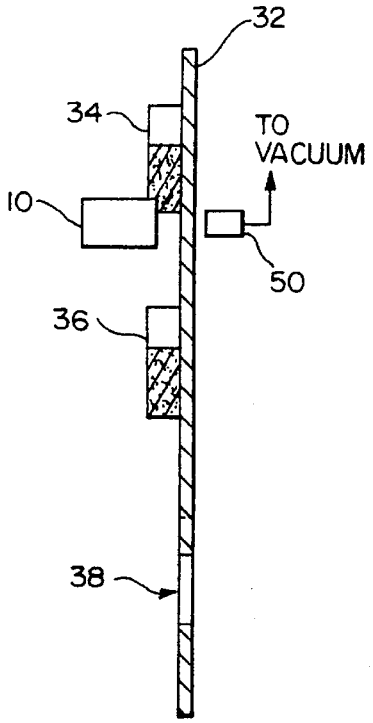
FIG. 5 is a planar side view of the cleaning media and page-wide-array printhead for the position of FIG. 4.
Figure 6:
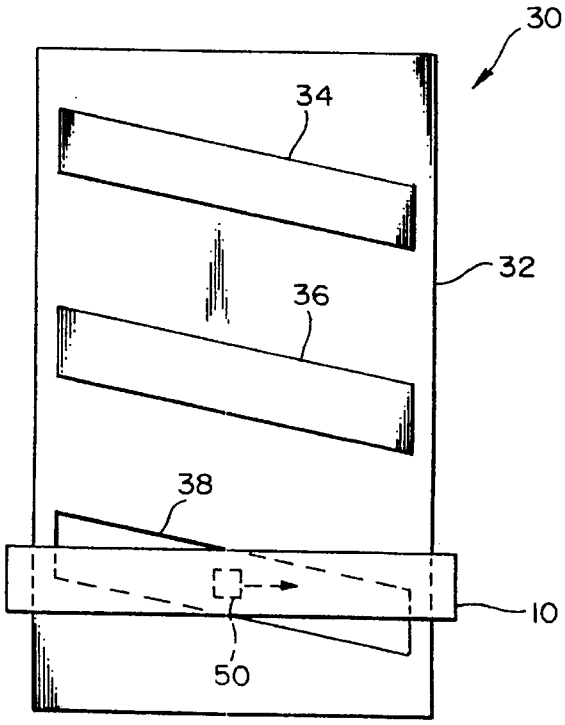
FIG. 6 is a planar top view of the cleaning media and page-wide-array printhead at another position.
Figure 7:
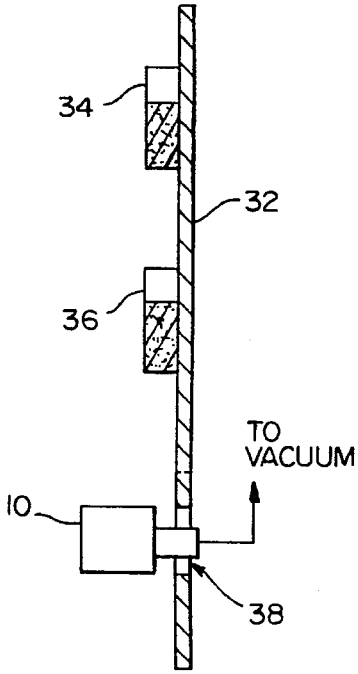
FIG. 7 is a planar side view of the cleaning media and page-wide-array printhead for the position of FIG. 6.

In one embodiment each pad 34, 36 is compliant and has a thickness (i.e., height) approximately twice the normal spacing between printhead 10 and conventional media (e.g., printing paper, transparencies). In an inkjet printer, the conventional spacing is 1 mm. Thus, in one embodiment, the solvent pad 34 and absorbent pad 36 are each 2 mm thick. FIG. 3 shows the pads 34, 36 protruding from the backing sheet 32 surface. The thickness of the pads 34, 36 and backing sheet 32 are exaggerated in FIG. 3 and other figures (i.e., FIGS. 5 and 7) merely for visual effect.

The width of the opening 38 is designed to enable a vacuum wand 50 (see FIG. 7) to protrude through the opening and scan the length of the opening while the cleaning media 30 moves relative to the printhead 10.

In the embodiment shown in FIGS. 2–7, the pads 34, 36 and opening 38 have an angled orientation relative to the square dimension of the backing sheet 32. In other embodiments, the pads 34, 36 and opening 38 run parallel to the pagewidth (i.e., zero angle of orientation). By angling the pads 34, 36 only a portion of the printhead is scrubbed at one time. Thus, there is less pressure applied to the printhead, and thus, less risk of moving the printbar. Also, by appropriately selecting the angle of orientation and spacing between the solvent pad 34 and absorbent pad 36, a more constant force is applied across the printhead 10 as the cleaning media 30 scrubs the surface 20.

Another factor in selecting the angle of orientation is to select an angle for the opening 38 such that the vacuum wand 50 can move straight across the printhead surface 20 as the cleaning media 30 is fed through the host printer. Thus, the angle is selected based upon the relative scanning speed of the vacuum wand 50 and feed speed of the cleaning media. The opening 38 and vacuum wand 50 are discussed in more detail in the section on the printhead cleaning method.

Printhead Cleaning Method

To clean the PWA printhead 10, the host printer is operated in a print preparation cycle. This cycle in instigated by a print command sequence issued from a host computer or by menu selection from a printer's user interface. The command sequence causes the print media transport subsystem to provide slow movement of a media through the printer. The slow movement allows more time for the cleaning media to be in contact with and "scrub" the printhead. The command sequence also maintains the inkjet nozzles inactive, so that ink is not fed into the nozzle area and nozzles are not energized to eject ink droplets. In one embodiment, initiation of the print preparation cycle results in a prompt for a user to feed in the cleaning media 30. The user removes tape sections 40, 42 from the solvent pad 34 and absorbent pad 36, respectively, then feeds the cleaning media 30 into the printer. Once fed, the cleaning media 30 moves through the printer along the media transport path.

As the cleaning media 30 moves along the media transport path, first, the solvent pad 34 encounters the printhead 10. As the solvent pad thickness exceeds the separation distance between normal media and the printhead 10, the solvent pad brushes against the printhead 10. The relative movement between solvent pad 34 and printhead 10 defines a scrubbing action enabling the solvent to soften, dissolve and/or remove dried ink and particulate matter.

For the illustrated embodiment, the solvent pad 34 has an angled orientation. As the solvent pad moves along the transport path, the pad 34 first contacts one end of the printhead 10 to define a contact area. As the cleaning media 30 moves progressively along the media path, the contact area moves progressively along the length of the printhead 10. By the time the solvent pad 34 has passed beyond the printhead 10, the entire portion of the printhead 10 having nozzles has been scrubbed.

As the cleaning media 30 continues movement along the transport path, the absorbent pad 36 encounters the printhead 10. As the absorbent pad 36 thickness also exceeds the separation distance between normal media and printhead 10, the absorbent pad 36 brushes against the printhead 10. The relative movement between absorbent pad 34 and printhead 10 defines a brushing action which wipes away the solvent and ink, wipes away or loosens particulate matter, and assists in drying the printhead 10.

For the illustrated embodiment, the absorbent pad 36 has an angled orientation. As the absorbent pad 36 moves along the transport path, the pad 36 first contacts one end of the printhead 10 to define a contact area. Depending on the angle and relative spacing between the solvent pad 34 and absorbent pad 36, the absorbent pad 36 contacts the printhead 10 either, (i) after the solvent pad 34 has completely passed out of contact with the printhead, or (ii) while a portion of the solvent pad 34 still is in contact with the printhead. As the cleaning media 30 moves progressively along the media path, the contact area between absorbent pad 36 and printhead 10 moves progressively along the length of the printhead 10. By the time the absorbent pad 34 has passed beyond the printhead 10, the entire portion of the printhead 10 having nozzles has been brushed.

The cleaning media 30 continues moving along the media transport path, so that, next, the opening 38 is adjacent to the printhead 10. Based upon a predetermined timing relationship or by sensing that the opening 38 is adjacent to the printhead, the vacuum wand 50 is activated. For example, by knowing the transport speed and the moment the transport begins, one can calculate the moment the opening 38 is positioned adjacent to the printhead 10. Alternatively, sensors in the paper path are used to detect the cleaning media and/or opening.

Once the opening 38 encounters the printhead 10, the vacuum wand 50 moves from a rest position to a position adjacent to or in contact with the printhead 10 and begins generating a suction force. The vacuum wand 50 defines a surface area which spans the width of the printhead's nozzle area. The vacuum wand 50 then scans the printhead length to vacuum the entire portion of the printhead 10 having nozzles 14. The suction force picks up loose particulate and particulate lodged within nozzle orifii.

In one embodiment, the vacuum wand 50 is part of a vacuum assembly. The vacuum wand 50 is coupled to a vacuum source by a tube. In addition a drive assembly (not shown) moves the vacuum wand 50 from a rest position to a position adjacent to the printhead 10, then along the printhead 10 in a substantially straight path. Once the printhead has been scanned, the drive assembly moves the vacuum wand 50 away from or out of contact with the printhead 10, then back to its rest position.

For the illustrated embodiment, the opening 38 has an angled orientation. As the opening 38 moves along the transport path, the opening 38 is first encountered by the printhead at one end of the printhead 10. As the cleaning media 30 moves progressively along the media path, the portion of the opening 38 positioned adjacent to the printhead 10 changes progressively so as to move along the length of the printhead 10. The movement of the vacuum wand 50 substantially tracks the relative motion of the opening 38 along the printhead, so that the wand 50 is free of encumbrance as the wand moves along the printhead 10 surface. By the time the opening 38 has passed beyond the printhead 10, the vacuum wand 50 has completed its scan of the printhead 10 and moved away from the printhead so as not to be bumped by the trailing portion of the backing sheet 32.

Once the media sheet 30 is fed completely through the host printer, the printer preparation cycle is complete and normal printing operations can begin or resume.

Meritorious and Advantageous Effects

One advantage of the invention is that the PWA inkjet printhead 10 is cleaned without removal or position adjustment. This is achieved because the cleaning media exerts minimal controlled forces against the printhead as it scrubs, brushes and vacuums against the printhead. Another advantage of this invention is that the cleaning procedure is simple enough for an end user to perform. The end user initiates the operation by a menu selection or other form of command input, then feeds in the cleaning media 30 (with tape coverings 40, 42 removed). Once the cleaning media 30 passes through the printer, the media 30 is discarded or recycled and normal printing can resume.

Although a preferred embodiment of the invention has been illustrated and described, various alternatives, modifications and equivalents may be used. Therefore, the foregoing description should not be taken as limiting the scope of the inventions which are defined by the appended claims.

What is claimed is:

1. A media sheet for feeding along a print media path of a page-wide array inkjet printer to clean printhead nozzles, comprising:

a backing sheet;

a first pad located on the backing sheet having an ink solvent for cleaning ink;

a second pad located on the backing sheet for absorbing ink and solvent; and wherein solvent from the first pad comes into contact with printhead nozzles while passing the backing sheet through a paper path of the printer; and wherein absorbing material of the second pad comes into contact with printhead nozzles to remove ink and solvent from the nozzles while passing the backing sheet through the paper path of the printer; and wherein an opening is defined in the backing sheet for encountering less than all nozzles of the page-wide-array printhead during a cleaning operation while the opening is positioned adjacent to a printhead nozzle the opening defining a scanning path along which a cleaning apparatus contacts the printhead as the backing sheet passes through the paper path of the printer.

2. The media of claim 1, in which the opening is angled relative to length and width dimensions of the backing sheet.

3. A method for cleaning a page-wide-array printhead of inkjet nozzles, comprising the steps of:

feeding a cleaning media along a paper path of an inkjet page-wide-array printer, the cleaning media comprising: (i) a backing sheet, (ii) an opening defined in the backing sheet, (iii) a first pad located on the backing sheet having an ink solvent for cleaning ink, and (iv) a second pad located on the backing sheet for absorbing ink and solvent;

passing the first pad adjacent to the page-wide-array printhead exposing printhead nozzles to the ink solvent;

passing the second pad adjacent to the page-wide-array printhead to wipe ink and solvent from printhead surface and nozzles;

passing the opening adjacent to the page-wide-array printhead;

moving a means for exerting suction into the opening adjacent to the page-wide-array printhead;

scanning, the suction exerting means along the page-wide-array printhead while the suction exerting means is within the opening; and vacuuming printhead nozzles with the suction exerting means during the step of scanning.

4. The method of claim 3, in which the steps of passing the opening, moving, scanning and vacuuming are performed after the steps of feeding, passing the first pad, and passing the second pad, and further comprising the step of:

moving the suction exerting means away from the printhead while the suction exerting means is within the opening.

5. The method of claim 4, in which the step of moving into the opening, comprises moving the suction exerting means away from a rest position into the opening adjacent to the page-wide-array printhead; and further comprising the step of returning the suction exerting means to the rest position.

6. An apparatus for cleaning page-wide array inkjet printer nozzles, comprising:

a backing sheet;

an opening defined in the backing sheet;

a first pad located on the backing sheet having an ink solvent for cleaning ink;

a second pad located on the backing sheet for absorbing ink and solvent; and means for exerting suction on an inkjet nozzle through the opening in the backing sheet;

wherein solvent from the first pad comes into contact with printhead nozzles while passing the backing sheet through a paper path of the printer; and wherein absorbing material of the second pad comes into contact with printhead nozzles to remove ink and solvent from the nozzles while passing the backing sheet through the paper path of the printer; and wherein the opening is for encountering less than all nozzles of the page-wide-array printhead at any given time while the backing sheet passes through the paper path of the printer; and wherein the suction exerting means scans along the page-wide-array printhead through the opening, while vacuuming printhead nozzles.

7. The apparatus of claim 6 in which the backing sheet opening is angled relative to length and width dimensions of the backing sheet, the opening defining a scanning path for the suction exerting means as the backing sheet passes through the paper path of the printer and the suction exerting means scans across the page-wide array printhead.

* * * * *